United States Patent [19]

Bailey

[11] 3,941,285

[45] Mar. 2, 1976

[54] APPARATUS FOR PRODUCING PANTY HOSE

[75] Inventor: Bill E. Bailey, Henderson, N.C.

[73] Assignee: Americal Corporation, Henderson, N.C.

[22] Filed: Apr. 28, 1975

[21] Appl. No.: 572,425

Related U.S. Application Data

[62] Division of Ser. No. 502,163, Aug. 30, 1974, Pat. No. 3,900,899.

[52] U.S. Cl. ..... 223/43

[51] Int. Cl.[2] ..... A41H 43/00

[58] Field of Search ..... 112/262; 223/43, 72–75, 223/39–42

[56] References Cited

UNITED STATES PATENTS

| | | | |
|---|---|---|---|
| 2,899,116 | 8/1959 | Long et al. | 223/43 |
| 3,641,589 | 2/1972 | Bryant | 223/43 X |

FOREIGN PATENTS OR APPLICATIONS

| | | | |
|---|---|---|---|
| 1,205,825 | 9/1970 | United Kingdom | 223/75 |
| 1,937,024 | 1/1970 | Germany | 223/72 |

*Primary Examiner*—G. V. Larkin

*Attorney, Agent, or Firm*—Parrott, Bell, Seltzer, Park & Gibson

[57] ABSTRACT

The slitting and seaming together of hosiery blanks for producing panty hose is carried out by a single operator and during the usual everting, inspecting and toe seaming operation. The hosiery blanks are slit as they are drawn onto a tubular hosiery form and the upper end engages a heated wire slitter supported on one side of the tubular form and a predetermined distance from the open free end of the form. The heated wire slitter is supported between spaced guide plates which aid in directing the panty forming end portion of the hosiery blanks into engagement with the heated wire slitter.

5 Claims, 5 Drawing Figures

APPARATUS FOR PRODUCING PANTY HOSE

This is a division of application Ser. No. 502,163, now U.S. Pat. No. 3,900,899 filed Aug. 30, 1974.

This invention relates generally to apparatus for producing panty hose and more particularly to the performance of the everting, inspecting, toe seaming, slitting and seaming together of a pair of hosiery blanks by a single operator.

The usual practice in producing panty hose is to knit seamless tubular hosiery blanks in right-side-out condition, transport the knit blanks to a first sewing operator where the blanks are everted, inspected and the toe ends are closed by a seaming operation and then transport the closed toe hosiery blanks to another operator where the upper ends are slit in a longitudinal direction and the slit edges of pairs of hosiery blanks are seamed together, with or without crotch patches or connecting panels, to complete the production of the panty hose. This usual method of producing panty hose requires unnecessary handling operations, thereby increasing production cost, and also increases the likelihood of forming picks and snags in the panty hose.

With the foregoing in mind, it is an object of the present invention to provide an apparatus for producing panty hose wherein the slitting of the hosiery blanks and seaming together of adjacent hosiery blanks is performed immediately following the usual everting, inspecting and toe seaming operation and by the same operator to thereby reduce the amount of handling required for the production of panty hose.

In accordance with the present invention, panty hose are produced by knitting pairs of seamless tubular blanks in right-side-out condition, drawing the panty forming end of a first hosiery blank up and over a tubular inspection form to evert the blank while engaging the panty forming end of the blank with a heated wire slitter which is fixed on the outside of the tubular form to longitudinally slit the first blank a predetermined distance from the end thereof as the panty forming end of the first blank is drawn up the outside of the tubular form to a predetermined location on the form. The toe end of the first blank is then sewn to close the same and this blank is turned back to right-side-out condition while it is removed from the form. These steps are then performed on a second tubular hosiery blank and the two blanks are joined together by seaming the corresponding edges of the slits to form the panty portion of the garment.

The apparatus for everting, inspecting and slitting tubular hosiery blanks is positioned immediately adjacent a sewing machine and includes an elongated tubular form having an open free end with a suction source connected to the other end of the tubular form for drawing air inwardly through the open end and along the length of the form. A heated wire slitter is supported on one side of the tubular form and a predetermined distance from the open end thereof. The heated wire slitter comprises a pair of guide plates extending longitudinally of the tubular form and including portions tapering outwardly and away from the open end of the tubular form so that the upper end of a hosiery blank is slit as it is drawn upwardly on the form and along the outwardly tapering portions of the guide plates to engage the heated wire slitter and slit the hosiery blank.

Other objects and advantages will appear as the description proceeds when taken in connection with the accompanying drawings, in which FIG. 1 is an isometric view of the everting, inspecting and slitting apparatus of the present invention and illustrating a fragmentary portion of the supporting table and sewing machine supported adjacent the open free end thereof;

Figure 1:
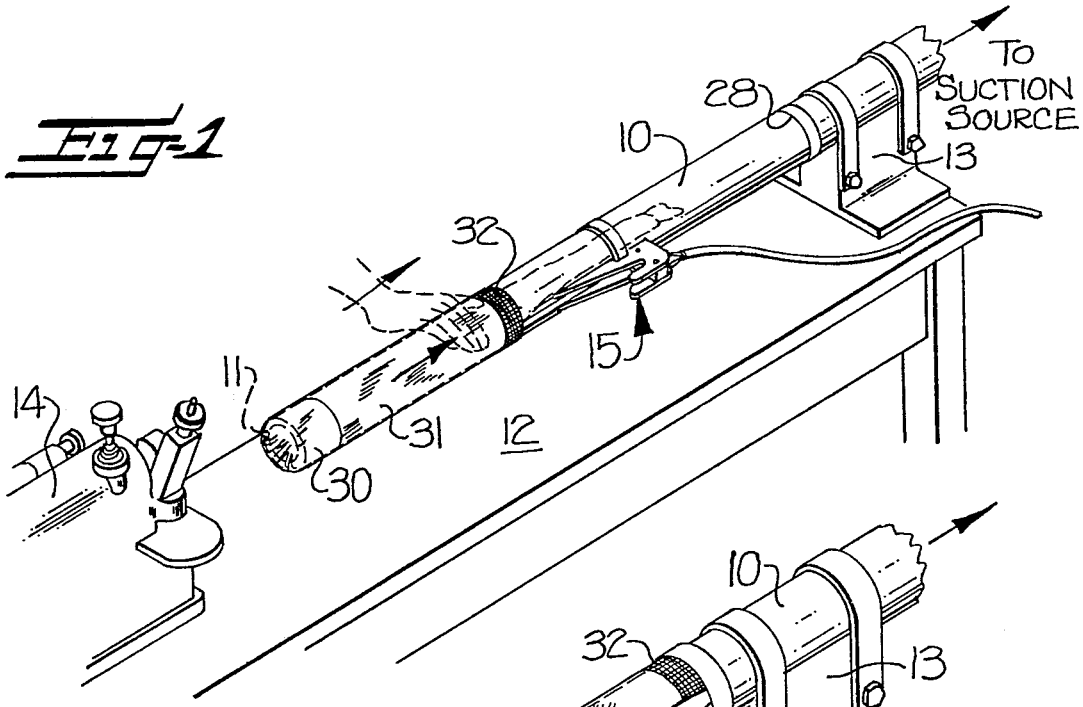

The everting, inspecting and slitting apparatus includes an elongate tubular form 10 having an open free end 11 (FIG. 1). The other end portion of the form 10 is suitably supported in spaced relationship above a work table 12 by means of a support block 13. The other end of the tubular form 10 is suitably connected to a convenient suction source, not shown, so that air is drawn inwardly through the open free end 11 and along the length of the tubular form 10 to create suction currents therein. A conventional sewing machine 14 is supported on the work table 12 and in spaced apart relationship adjacent the free end 11 of the tubular form 10. This sewing machine 14 may be of any conventional type and is preferably of the type which is adapted to form an overedged seam and which is provided with a trimmer for cutting away the excess material just prior to the overedge seam being formed.

Figure 5:
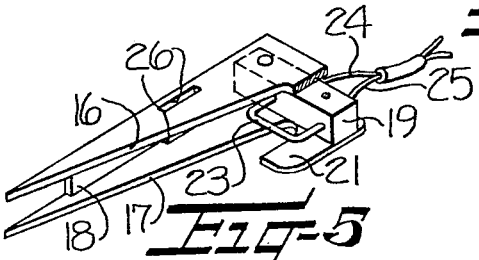
FIG. 5 is an enlarged isometric view, with parts broken away, of the slitting device removed from the tubular form.

A heated hot wire slitter, broadly indicated at 15, is supported on one side of the tubular form 10 and is positioned a predetermined distance from the open free end 11. The heated wire slitter 15 includes a pair of guide plates extending longitudinally of the elongate tubular form 10 and having portions 16, 17 tapering outwardly and away from the open end 11 of the tubular form (FIG. 5). A spacer plate 18 maintains the forward ends of the guide plates in spaced apart relationship and a spacer block 19 extends across and between the rear ends of the guide plates 16, 17. Upper and lower guard portions 20, 21 extend parallel with the tube 10 and are joined to the outwardly tapering portions 16, 17 to define slots therebetween.

As best illustrated in FIG. 5, the heated wire, indicated at 23, is U-shaped and the legs thereof extend into and are supported in the spacer block 19. Electric wires 24, 25 are connected to the legs of the U-shaped heated wire 23 and are suitably connected to any source of electrical energy, not shown. The medial portion of the U-shaped heated wire 23 extends across and between the slots in the guide plates so that the heated wire is protected from engagement by the operator. When the upper end of a hosiery blank is drawn up the tubular form 10, it is guided up the outwardly tapering portions 16, 17 of the guide plates and into engagement with the transversely extending medial portion of the wire 23 so that the fabric is slit. Slots 26 are provided in the guide plates and a band 27 extends through the slots and around the tubular form to maintain the heated wire slitter 15 in the desired longitudinal position on the form 10. A guide band or mark 28 is provided near the end of the form 10 as an indication to the operator where the upper end of the hosiery blank 50 is to be drawn in order to provide the desired length of slit in one side of the tubular hosiery blank.

METHOD OF OPERATION

Figure 4:
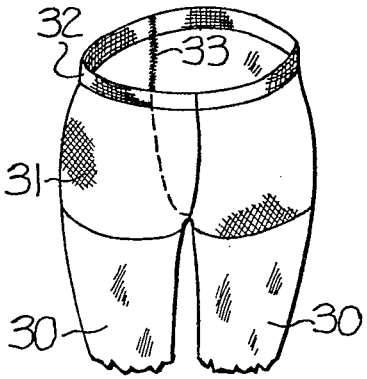
FIG. 4 is a perspective view of the upper end of a panty hose, illustrating the manner in which the slit edges of two adjacent hosiery blanks are seamed together to complete the panty portion thereof.

The method of producing panty hose in accordance with the present invention includes knitting seamless tubular hosiery blanks in right-side-out condition with one end of each blank being adapted to form the toe and the other end being adapted to form one-half the panty portion and one-half of the waist opening of the panty hose. As is well-known, hosiery blanks are usually produced by a hosiery knitting machine with both ends open and it is the usual custom to employ a fine denier yarn in knitting the leg portion and to employ a heavier denier yarn in the upper portion of the hosiery blank which is adapted to form the panty portion of the panty hose. The sheer legs of the hosiery blank are indicated at 30 in FIG. 4 and the heavier denier panty portion is indicated at 31. If desired, a turned welt waistband portion, indicated at 32 in FIG. 4, may be formed on the knitting machine.

Figure 2:
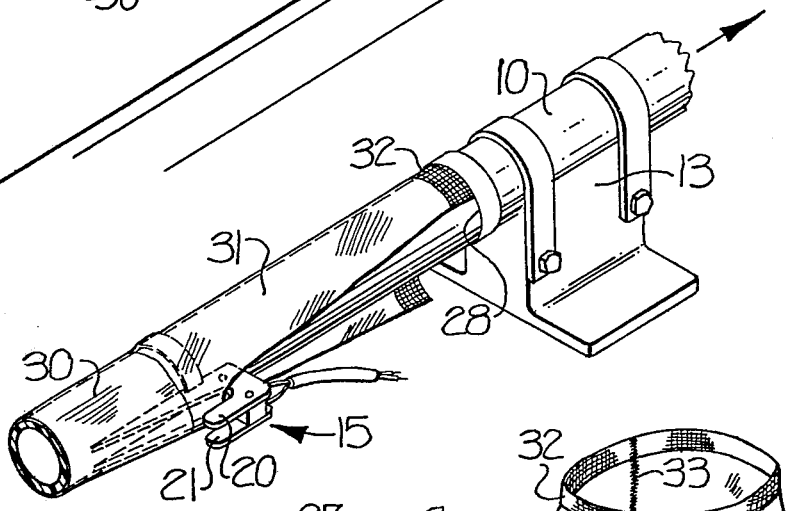
FIG. 2 is an enlarged view of the upper end of the apparatus shown in FIG. 1 and illustrating the manner in which the upper end of a hosiery blank is slit by the heated wire slitter as it is drawn up onto the tubular form to the proper position.
Figure 3:
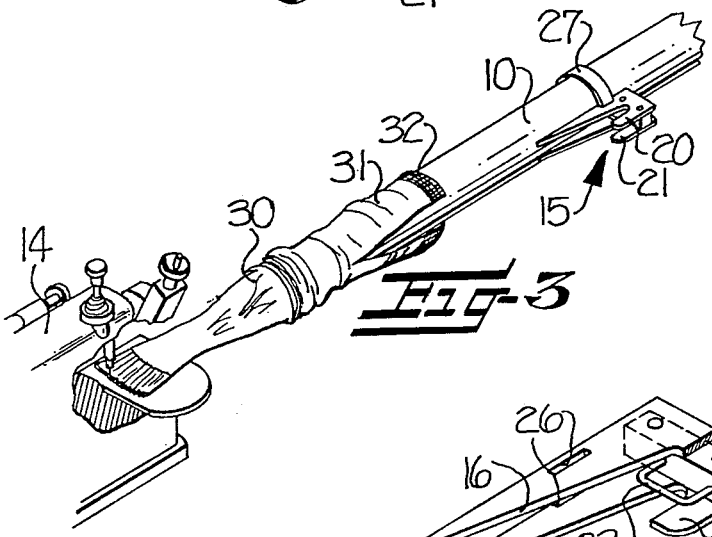
FIG. 3 is a fragmentary isometric view of the apparatus illustrating the manner in which the toe end of the stocking is closed while a portion of the slit end of the hosiery blank is maintained on the tubular form.

The knit hosiery blanks are placed near the sewing machine operator and panty hose are produced from pairs of the seamless tubular blanks at the single operator station illustrated in FIG. 1. The toe end of the first of the blanks is positioned adjacent the open end 11 of the tubular form 10 so that the toe end and a substantial length of the first blank is drawn into the tubular form by suction currents therein, as illustrated in FIG. 1. The upper panty forming portion of the tubular blank is then drawn up and over the tubular form 10 to evert this first blank. As the upper end of the first blank is drawn up the outside of the tubular form, it engages and rides up the tapered portions 16, 17 of the heated wire slitter 15 and the fabric is slit by the medial portion of the U-shaped heated wire 23, as illustrated in FIG. 2. When the upper end of the blank reaches the indicator line or mark 28, the upper end of the hosiery blank has been slit to the desired length. While in this condition, the blank may be inspected for defects and the upper end of the hosiery blank is then moved downwardly on the form 10 to substantially the position shown in FIG. 3 and the operator proceeds to close the toe end of the hosiery blank by use of the sewing machine 14. The closed toe end of the hosiery blank is then permitted to be drawn into the form 10 so that the blank is turned back to right-side-out condition as the operator withdraws the hosiery blank out of the tubular form 10.

A second hosiery blank is then everted, inspected, slit and the toe closed in the same manner as the first blank. The operator then connects the corresponding slit edges of the two hosiery blanks together by a seaming operation, as by a U-shaped seam, indicated at 33 in FIG. 4. The seam 33 extends from the rear of the garment at the waist opening downwardly, through the crotch of the garment and up the front to the waist opening. If desired, a crotch patch or panel may be inserted between the edges of the two hosiery blanks to provide increased width in the desired portions of the panty of the panty hose.

Thus, the everting, inspecting, slitting, toe closing and joining together of pairs of hosiery blanks is carried out at a single position and by a single operator to thereby reduce the number of handlings which are required of the stocking blanks in the formation of panty hose. Further, the slitting of the fabric by the heated wire 23 tends to fuse the yarn ends and aids in preventing runs and the like in the panty hose. Also, the configuration of the guide plates above and below the heated wire 23 protect the operator from engagement with the heated wire as the upper end of the hosiery blank is drawn up onto the form 10.

In the drawings and specification there has been set forth a preferred embodiment of the invention, and although specific terms are employed, they are used in a generic and descriptive sense only and not for purposes of limitation.

That which is claimed is:

1. An apparatus for everting, inspecting and slitting tubular panty hose blanks, said apparatus comprising a. an elongate tubular form having an open free end, b. means associated with the other end of said tubular form for drawing air inwardly through the open free end and along the length of said tubular form to create suction currents therein, and c. a heated wire slitter supported on one side of said tubular form and a predetermined distance from the open free end thereof, said heated wire slitter including a portion extending transversely and outwardly from said one side of said tubular form to engage and slit a tubular panty hose blank as the blank is drawn onto said tubular form and beyond said heated wire slitter.

2. An apparatus according to claim 1 wherein said heated wire slitter comprises a pair of guide plates extending longitudinally of said elongate tubular form and including portions tapering outwardly and away from the open end of said tubular form, a spacer block connecting said guide plates together in spaced apart relationship, and wherein said heated wire slitter extends outwardly beyond the outwardly tapering portions of said guide plates to engage and slit a hosiery blank as it is drawn upwardly on said form and along the outwardly tapering portions of said guide plates.

3. An apparatus according to claim 2 wherein said guide plates include slots therein and including a band extending through the slots in said guide plates and surrounding said tubular form to hold said heated wire slitter in position thereon.

4. An apparatus according to claim 2 wherein said heated wire slitter is U-shaped and the legs thereof are supported in said spacer block.

5. An apparatus according to claim 4 wherein said guide plates include guard portions extending parallel with said tubular form and being joined to said outwardly tapering portions to define slots therebetween, the medial portion of said heated wire slitter extending across and between the slots in said guide plates.

* * * * *